United States Patent [19]

Maier et al.

[11] Patent Number: 4,862,125

[45] Date of Patent: Aug. 29, 1989

[54] ELECTRICAL SWITCHING DEVICE WITH COVER INTERLOCK

[75] Inventors: Alfred E. Maier, Chippewa; James R. Farley, Plum Borough, both of Pa.

[73] Assignee: Westinghouse Electric Corp., Pittsburgh, Pa.

[21] Appl. No.: 241,734

[22] Filed: Sep. 8, 1988

[51] Int. Cl.[4] ..... H01H 9/02

[52] U.S. Cl. ..... 335/202; 200/43.01

[58] Field of Search ..... 335/131-133, 335/202, 6; 200/43.01, 43.02, 43.04, 43.05, 43.07, 43.08-43.09, 43.14-43.15, 43.21-43.22, 43.16, 50 R, 50 A; 292/341.14

[56] References Cited

U.S. PATENT DOCUMENTS 4,540,961 10/1985 Maier .

*Primary Examiner*—E. A. Goldberg

*Assistant Examiner*—Donovan

*Attorney, Agent, or Firm*—M. J. Moran

[57] ABSTRACT

Electrical switches and circuit breakers in which the contacts and operating mechanism are enclosed within an insulating housing by an insulating cover and which have an elongated operating handle extending through an elongated slot in the cover have an enlarged terminal portion of the operating handle which is wider than the slot to prevent removal of the cover except in positions of the handle at which the electrical contacts are open and the slot is wider than the terminal portion of the handle. Preferably, this is only the OFF position of the switch or breaker, however, in circuit breakers with a notch at the trip position to expose indicia indicating the breaker operating condition, a transverse pin through the operating handle permitting removal of the cover only with the operating handle in the trip position, provides an economical backfit.

7 Claims, 5 Drawing Sheets

ELECTRICAL SWITCHING DEVICE WITH COVER INTERLOCK

BACKGROUND OF THE INVENTION

1. Field of the Invention

This invention relates to switching devices and particularly circuit breakers in which electrical contacts and an operating mechanism therefor are enclosed by a removable cover in an insulated housing with an operating handle extending outward through and movable in a slot in the cover. More specifically, the invention is directed to an interlock associated with the handle which prevents removal of the cover if the electrical contacts are not open.

2. Background Information

Electrical switching devices, such as in particular, circuit breakers, typically have one or more sets of electrical contacts and an operating mechanism for the contacts inserted through an opening into an insulated housing. The opening is closed by a cover so that the electrical contacts and operating mechanism are completely enclosed. Typically, a handle connected to the operating mechanism extends outward through a slot in the cover. This handle, through which the contacts can be manually operated, also provides a visual indication of the position of the electrical contacts and of the operating mechanism. Circuit breakers include a trip unit which actuates the operating mechanism to open the contacts in response to abnormal current flow through the device. This tripping of the circuit breaker moves the handle to a trip position which provides a visual indication of the trip.

Normally, the circuit breaker is connected so that only the stationary contacts are energized when the circuit breaker is tripped or off. However, when the contacts are closed there is a completed circuit through the contacts and portions of the trip unit. Removal of the cover with the contacts closed exposes these energized components. While the stationary contacts remain energized when the device is tripped or off, typically they are located in the deepest recesses of the housing and are not as likely to be contacted.

In some applications, low cost circuit breakers having the basic configuration described above are utilized as switches for particular loads, such as for instance, motors. While such devices may provide protection against severe overloads or faults, their primary function is as a switch. Removal of the cover from such a switch when the contacts are closed, also exposes energized components.

There is a need therefore for a simple, economical interlock for the above described switching devices which prevents removal of the cover, and therefore exposure of energized components, when the electrical contacts are closed.

There is a further need for such an interlock which can be easily applied to existing switching devices.

SUMMARY OF THE INVENTION

These and other needs are satisfied by the invention in which the operating handle connected to the operating mechanism for the contacts in an electrical switching device extends through an elongated, enclosed slot in a cover which encloses the operating mechanism and electrical contacts in an insulating housing and has a terminal portion which is enlarged in a direction transverse to the elongated slot. The operating handle moves in the elongated slot between a first position in which the electrical contacts are open and a second position in which the contacts are closed. The elongated enclosed slot has a width at the first position of the operating handle which is wider than the enlarged terminal portion of the handle so that the cover can be removed with the handle in this first position. However, the width of the elongated slot at the second position of the operating handle in which the electrical contacts are enclosed is narrower than the enlarged terminal portion of the handle such that the cover can not be removed with the operating handle in this second position. Hence, the cover can only be removed when the electrical contacts are open thereby reducing the possibility of contact with energized components.

In the case of circuit breakers, which include trip means to trip the operating mechanism and open the electrical contacts in response to abnormal current through the device, the operating handle has a TRIP position within the elongated slot in addition to OFF and ON positions Preferably, the width of the elongated slot at the TRIP position of the operating handle is also narrower than the enlarged terminal portion of the operating handle so that even though the electrical contacts are open when the breaker is tripped, the cover can still not be removed with the operating handle in the tripped position. This is advisable because in certain circuit breakers, the operating handle can be moved manually to the TRIP position without opening the electrical contacts due to the operation of a latch in the operating mechanism which must be reset following a trip.

For an economical back fit of the invention to a breaker having a wider portion of the elongated slot at the trip position of the operating handle through which indicia are visible to emphasize the operating condition of the breaker, the enlargement of the terminal portion of the handle can be effected to accommodate this existing widened portion of the slot. Incorporation of the invention into such breakers can be accomplished quickly and economically by drilling a hole transversely through the terminal portion of the handle and inserting a pin over which the widened portion, but not the remaining portion, of the elongated slot may pass to remove the cover. Thus, in this embodiment of the invention, the cover can only be removed when the operating handle is in the TRIP position.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
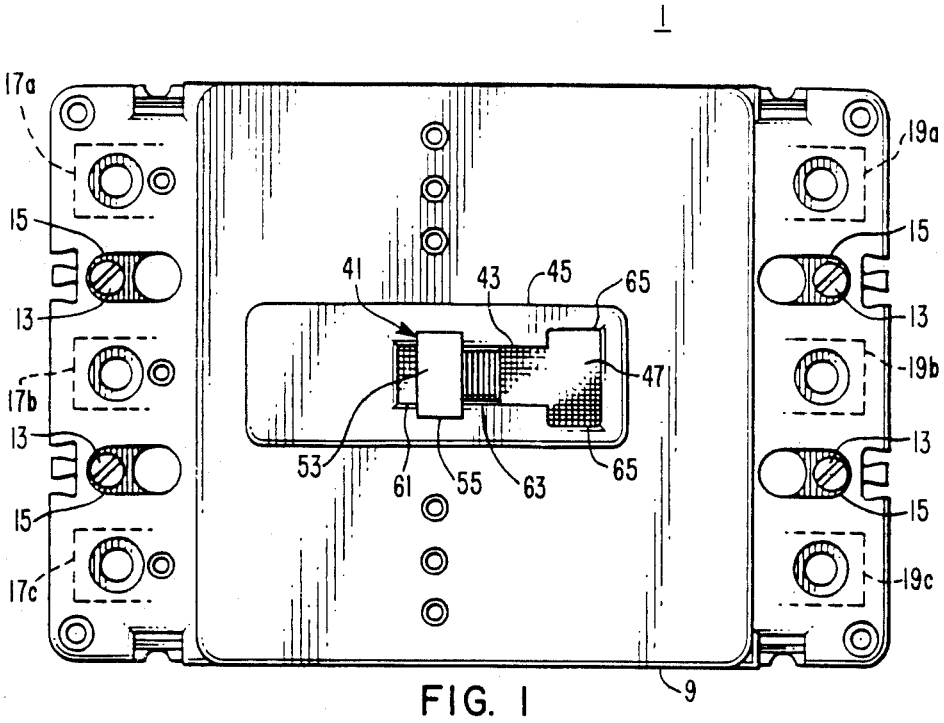
FIG. 1 is a top plan view of a molded case circuit breaker incorporating the invention.
Figure 2:
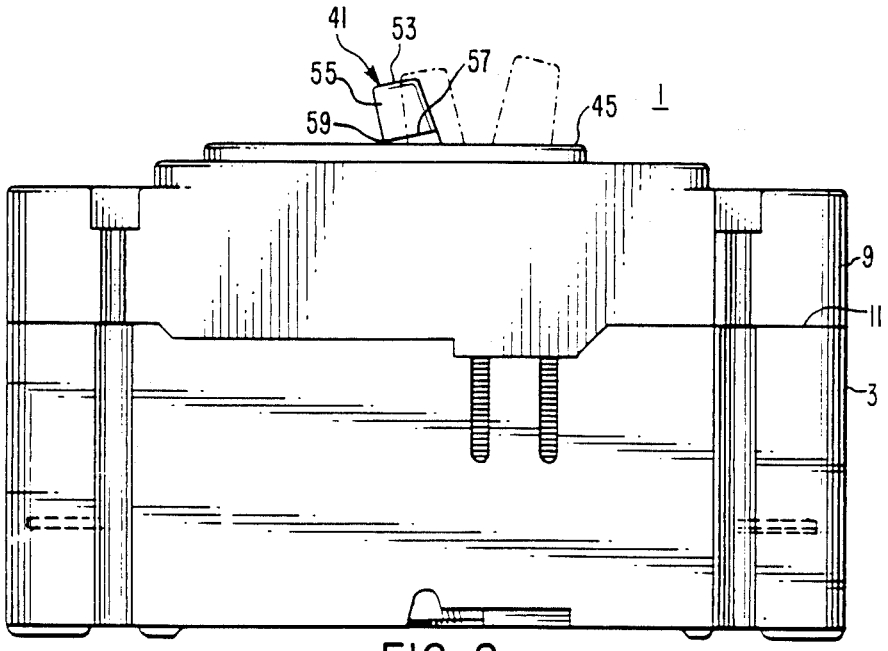
FIG. 2 is a side elevational view of the molded case circuit breaker of FIG. 1.

The invention will be described as applied to the molded case circuit breaker described in U.S. Pat. No. 4,540,961 which is hereby incorporated in full by reference.

Referring to FIGS. 1 through 3 and 7, the circuit breaker 1 comprises a molded, electrically insulating housing 3 forming a cavity 5 having an opening 7. A molded, electrically insulating cover 9 joins the housing 3 along parting line 11 to close the opening 7 and completely enclose the cavity 5. The cover 9 is secured to the housing 3 by a number of fasteners 13 received in recesses 15 in the cover.

The circuit breaker 1 shown is a three phase or three pole switching device. Hence, three first electrical terminals (line terminals) 17A, 17B and 17C, one for each pole or phase, are provided at one end of the housing 3 Three additional, second terminals (load terminals) 19A, 19B and 19C are provided at the other end of the housing 3. These terminals are used to serially connect the circuit breaker 1 into a three phase electrical system to be protected.

The major internal components of the circuit breaker 1 are sets 21 of electrical contacts, an operating mechanism 23 and trip means 25. A separate set of contacts 21 and trip means 25 is provided for each phase, however, the operating mechanism 23 is common to all three phases. Each set of contacts 21 comprises a lower contact 27 secured to a rotatable lower contact arm 29 and an upper contact 31 carried by a rotatable upper contact arm 33. The lower contact arm 29 is connected to the line terminal 17 while the upper contact arm 33 is connected through a flexible conductor 35 and trip unit 25 to the load terminal 19. Thus, with the contacts 27 and 29 closed, an electrical circuit is completed between each line terminal 17 and the corresponding load terminal 19. With the contacts 27, 29 open the lower contact 27 remains "hot", but the upper contact 29 and trip unit 25 are deenergized. Although the lower contact 27 and the arm 29 on which it is mounted remain energized when the contacts 27 and 31 are open, they are located deep within the cavity 5 of the housing 3. The remaining components are deenergized. It is the primary object of the present invention that the cover only be removable when the contacts 27, 31 are open.

A conventional arc chute 30 is provided to help extinguish the arc caused by opening of the contacts 27, 31 and thus to limit fault current. A slot motor 32 is also provided to perform the known function of concentrating the magnetic field generated by a high level circuit or fault current condition, thereby greatly increasing the magnetic repulsion forces between separating electrical contacts 27, 31 to rapidly accelerate separation of the contacts.

Figure 3:
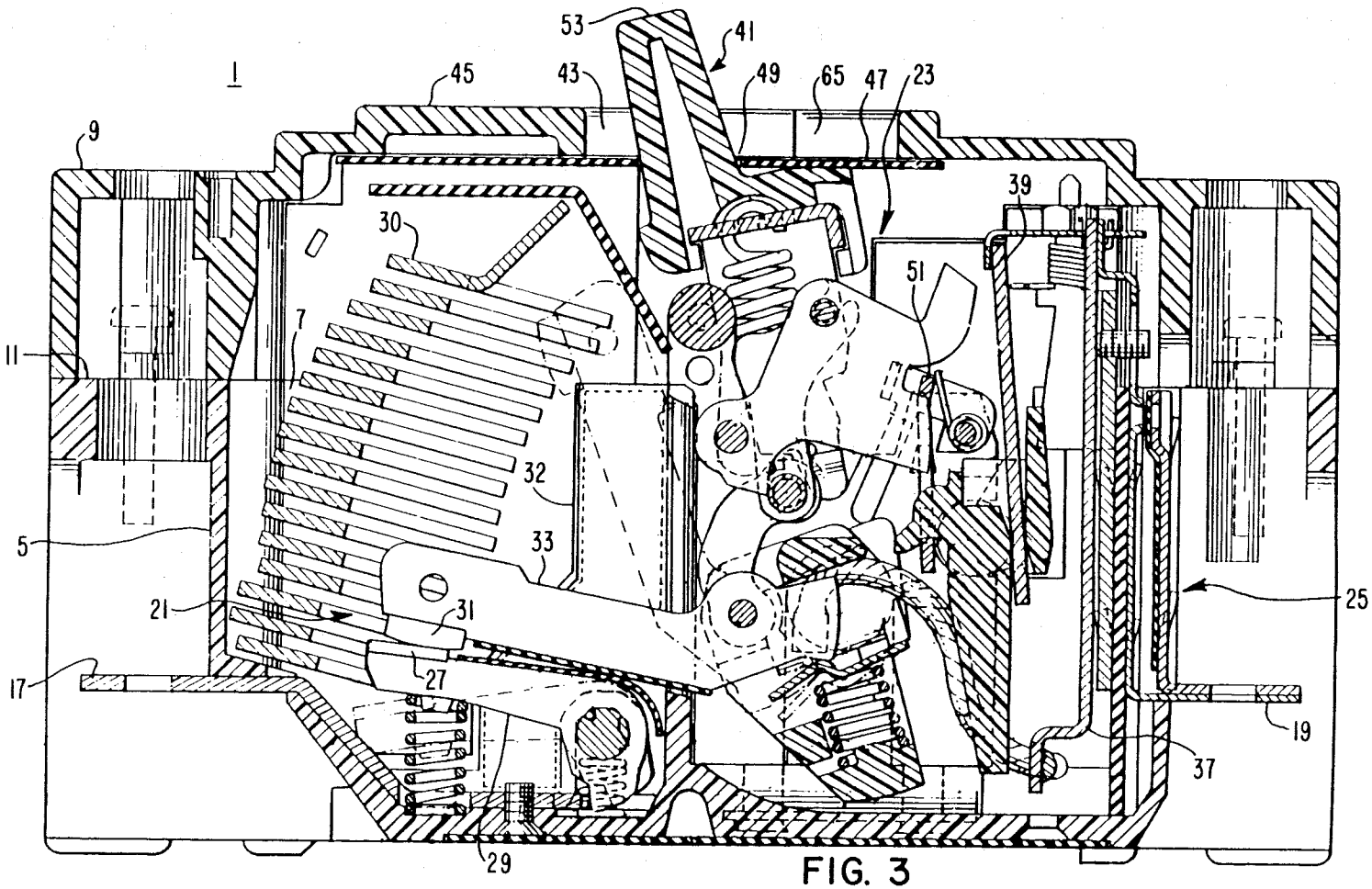
FIG. 3 is a longitudinal, vertical sectional view of the circuit breaker of FIG. 1 taken along the line 3—3 in FIG. 1 showing the device in its closed or ON position, and through parts in phantom, in its blown open position.
Figure 4:
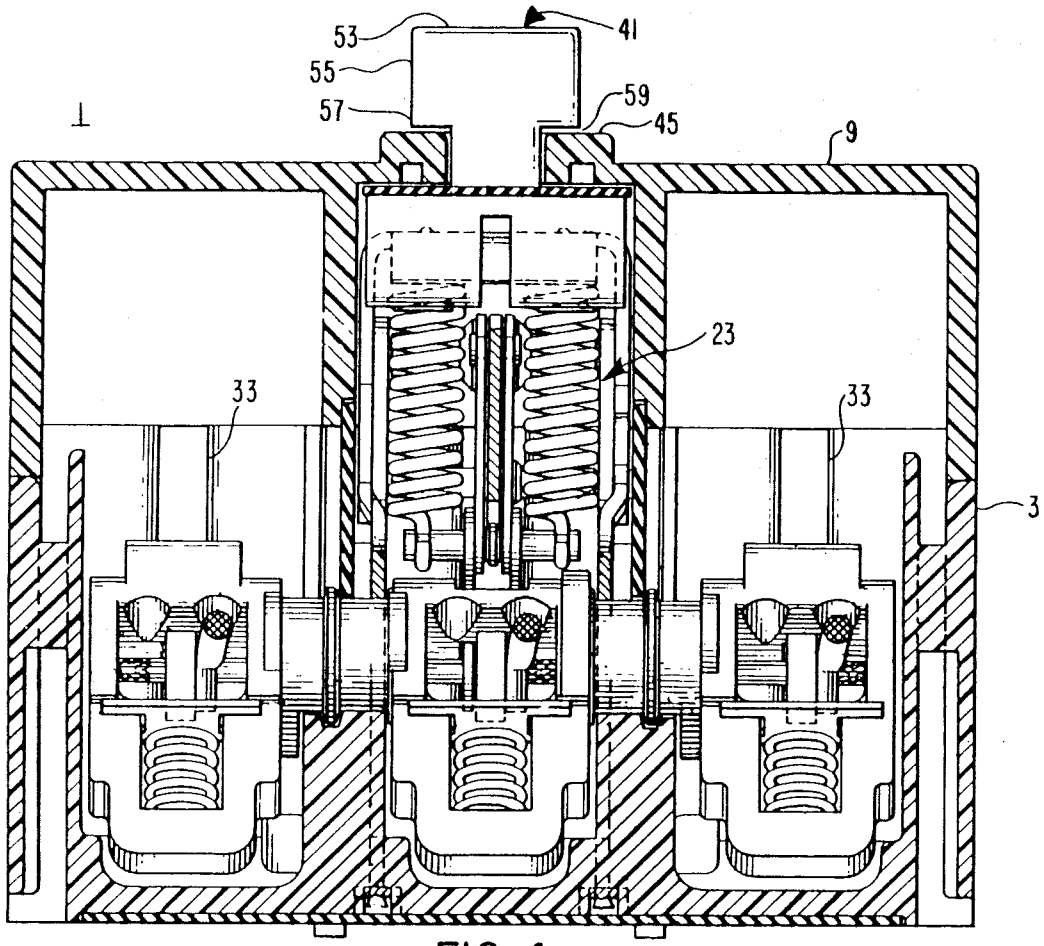
FIG. 4 is transverse vertical sectional view through the circuit breaker of FIG. 1 taken along the line 4—4 in FIG. 3.
Figure 6:
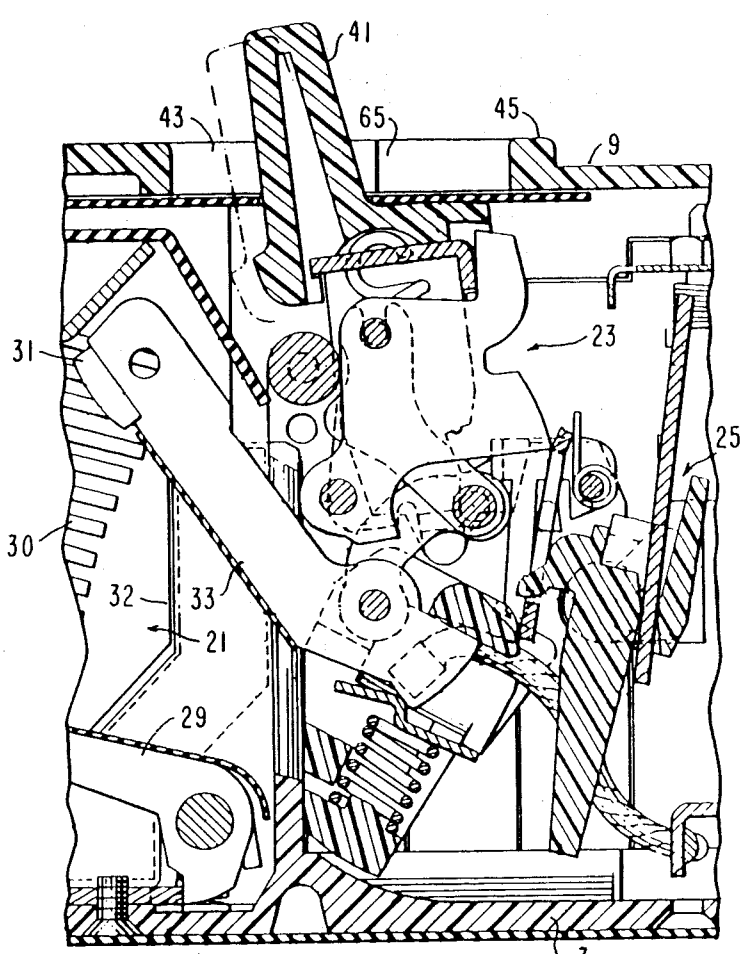
FIG. 6 is a fragmentary sectional view similar to that of FIG. 5 but showing the device in the tripped position.
Figure 5:
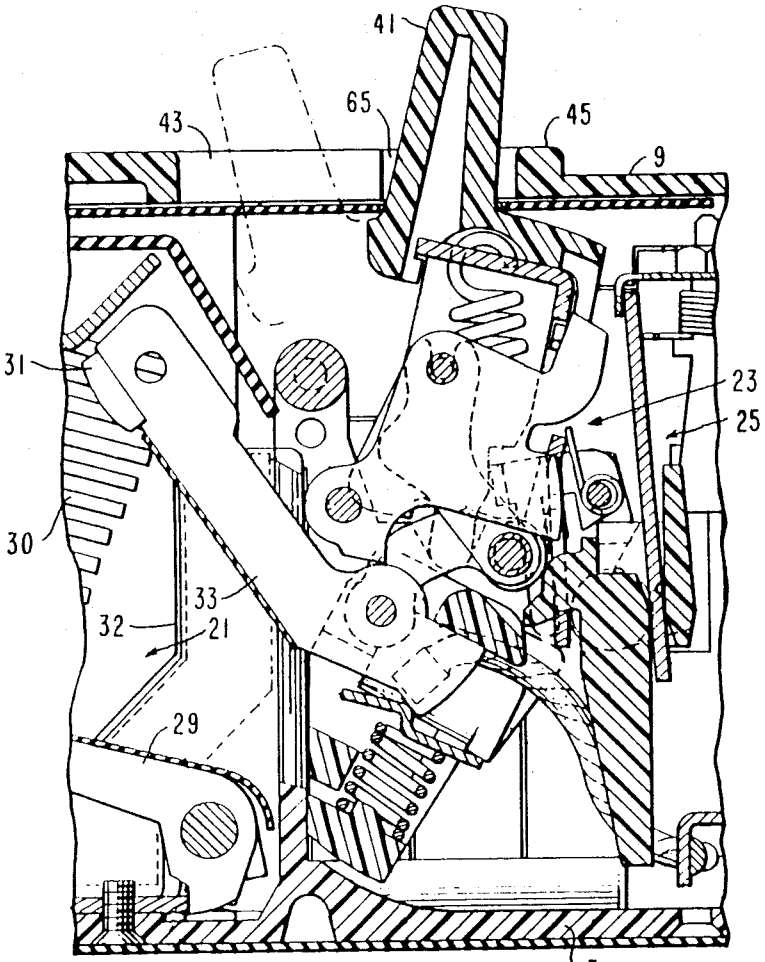
FIG. 5 is a fragmentary sectional view of the circuit breaker of FIG. 1 taken along the same line as FIG. 3 showing the device in the open or OFF position.

The operating mechanism 23 operates the upper contact arm 33 carrying the upper contact 31 between an ON position shown in full line in FIG. 3, in which the contacts 27, 31 are closed, an OFF position in which the contacts are open as shown in FIG. 5, a TRIP position shown in FIG. 6 in which the contacts are also open, and a BLOWN-OPEN position when in phantom in FIG. 3. The operating mechanism 23 is operated automatically or manually. It is operated automatically to the TRIP position shown in FIG. 6 by a trip unit 25. Each trip unit 25 includes a bimetal thermal device 37 responsive to persistent low level overloads to trip the operating mechanism 23 and thereby open the contacts 27, 31. Each trip unit 25 also includes a magnetic device 39 which responds to high overload currents to trip the operating mechanism 23. Very high overload currents cause the contact arms 29 and 33 to rapidly separate due to magnetic repulsion forces, thereby also opening the contacts. The operating mechanism 23 operates all three sets of contacts 27, 31 in unison. Thus, when a trip unit associated one phase operates, the operating mechanism 23 opens the contacts 27, 31 in all three phases. While the sets of contacts 21 are blown open individually, the current needed to do so, will be sufficient to operate the magnetic trip so that the remaining sets are opened by the operating mechanism 23.

The operating mechanism 23 is operated manually by a molded electrically insulating elongated handle 41 secured to the operating mechanism 23 and extending through an elongated slot 43 in a thickened section 45 of the cover 9. The operating handle 41 moves arcuately between the ON position at one end of the elongated slot 42 as shown in FIG. 3 and the Off position at the other end of elongated slot 43 as shown in FIG. 5, with an intermediate TRIP position shown in FIG. 6. An electrically insulating strip 47 having an aperture 49 through which the operating handle 41 extends is carried by the handle and covers the bottom of the elongated slot 43 to complete electrical insulation of the internal components of the circuit breaker.

The operating handle 41 can be used to manually operate the operating mechanism 23 and moves with the operating mechanism during automatic operation. Thus, the operating handle 41 serves the dual function of providing a means to operate the circuit breaker manually and of providing a visual indication of the condition of the breaker.

Details of the operating mechanism 23 and trip unit 25 and their operation are fully disclosed in U.S. Pat. No. 4,540,961 which has been incorporated by reference into this description. From this patent it will be seen that, when the breaker has been tripped, the operating handle 41 must be brought to the OFF position shown in FIG. 5 in order to operate a latch 51 in the operating mechanism 23 which resets the breaker for a trip prior to returning the operating handle 41 to the ON position to close the contacts 27, 31. Due to the construction of the latch 51, it is possible to manually move the operating handle 41 against a spring bias from the ON position to the TRIP position without opening the contacts 27, 29. However, whenever the operating handle 41 is in the OFF position, the contacts 27, 31 are open.

In its preferred form, the invention provides, therefore, that the cover 9 can only be removed when the operating handle 41 is in the OFF position shown in FIG. 5. To this end, the terminal portion 53 of the operating handle 41 is enlarged as at 55 in the direction transverse to the elongated slot 43. Preferably, the operating handle 41 is molded with this lateral projection 55 as an integral part of the operating handle 41, and preferably extending from both sides of the terminal portion 53. Since the operating handle 41 moves through an arcuate path in the slot 43, the lower edge 57 of the projection 55 is preferably shaped to maintain close clearance 59 with the top surface of the thickened section 45 of the cover when the operating handle 41 is in the ON position.

As seen in FIG. 1, the width of the elongated slot 43 at the ON 61 and TRIP 63 positions of the operating handle 41 is narrower than the elongated terminal portion 53 of the operating handle so that the cover cannot be lifted from the housing 3 in these positions of the operating handle. Since the slot 43 is enclosed, the covering cannot be slid laterally to remove it. It must be lifted up over the operating handle 41.

Figure 7:
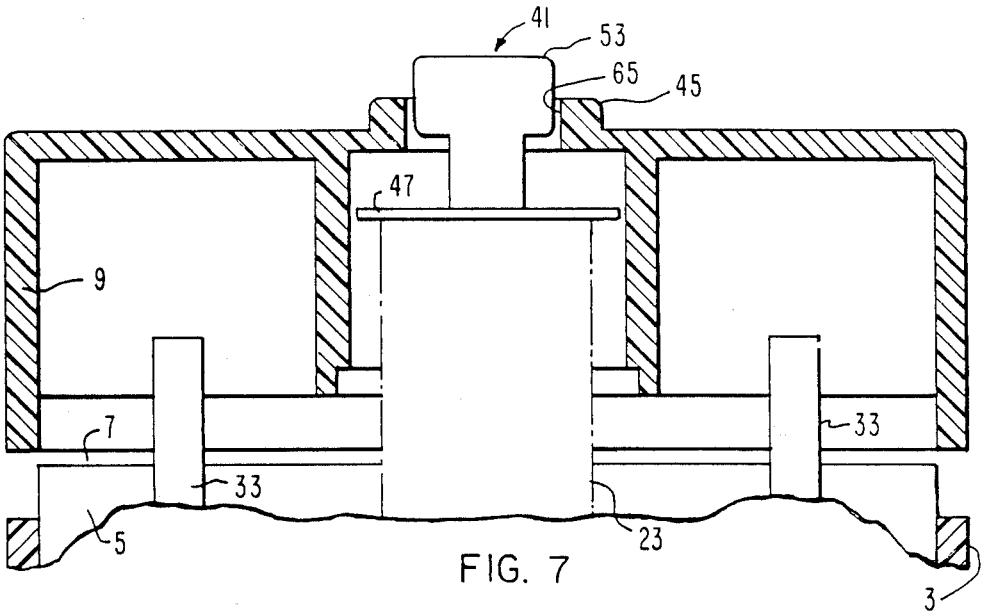
FIG. 7 is a fragmentary, cross sectional, partially schematic view through the breaker showing the handle in the OFF position with the cover partially raised.

At the OFF position of the operating handle 41, the width 65 of the elongated slot 43 is greater than that of the enlarged terminal portion 53 of the handle and thus the cover 9 can be lifted off over the handle 41 as shown in FIG. 7.

Figure 8:
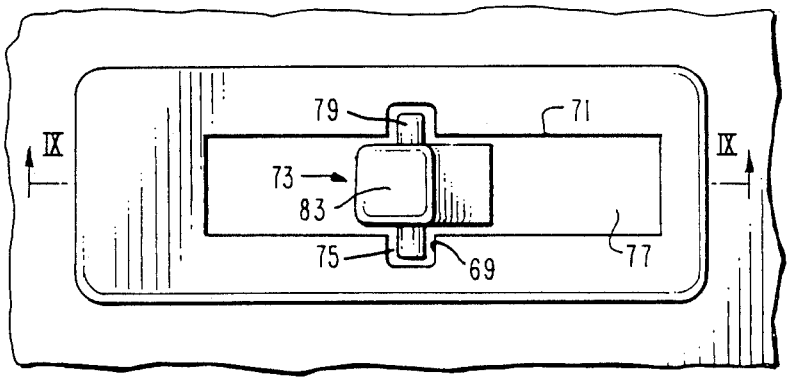
FIG. 8 is a fragmentary top plan view of a circuit breaker incorporating another embodiment of the invention.
Figure 9:
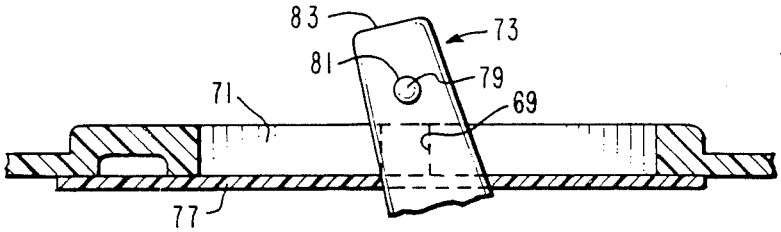
FIG. 9 is a fragmentary sectional view of the circuit breaker of FIG. 8 taken along the line 9—9 in FIG. 8.

FIGS. 8 and 9 show a modified form of the invention which provides a simple economical back fit for circuit breakers 67 provided with notches 69 exposing indicia 75 applied to the upper surface of the insulating strip 77 under the slot 71. These indicia 75 provide an additional indication of the condition of the breaker. In a known circuit breaker 67 of this type, the indicia comprise colored areas on the strip 77; red for ON, green for OFF; and white for TRIPPED. A pin 79 inserted in a transverse hole 81 drilled through the terminal portion 83 of the operating handle 73 provides the enlarged portion of the handle which prevents removal of the cover 9 with the operating handle in the ON position, but which is aligned with the notches 69 when the handle is in the TRIP position. Thus, the cover can be removed only with the handle 73 in the TRIP position. If the breaker is in the OFF position, the handle can be manually moved to the TRIP position to align the pin 79 with the notches 69. Unfortunately, as discussed previously, the handle 73 can also be manually moved from the ON position to align the pin 79 with the notches 69 and remove the cover even though the contacts 27, 31 remain closed. Thus, the preferred embodiment of the invention is that described first in which the cover can only be removed with the handle in the OFF position where the contacts 27, 31 can only be open.

While the invention has been described in detail in connection with circuit breakers, it is to be understood that it is also applicable to other electrical switching devices such as switches having an operating handle which moves in a slot in a cover between positions in which the contacts are open and closed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An electrical device comprising:

first and second electrical contacts;

an operating mechanism operative to open and close said first and second electrical contacts;

an operating handle secured to said operating mechanism and movable therewith between a first position in which said first and second contacts are open and a second position in which said first and second contacts are closed;

a housing having an opening through which said first and second contacts and said operating mechanism are inserted into said housing, and a cover removably secured to the housing over said opening to enclose said first and second electrical contacts and said operating mechanism, and defining an enclosed elongated slot through which said handle extends and is movable between said first and second positions, said handle having a terminal portion extending beyond said cover and which is enlarged in a direction transverse to the elongated slot, said elongated slot having a width at the first position of the handle which is wider than the enlarged terminal portion of the handle and a width at the second position of the handle which is narrower than the enlarged terminal portion of the handle, whereby the cover is only removable from the housing when the handle is in the first position and hence when the first and second electric contacts are open.

2. The switching device of claim 1 adapted for use as a circuit breaker and including a trip means responsive to an abnormal current flowing through said first and second contacts when closed to operate said operating mechanism to a tripped condition in which said first and second electrical contacts are open, said operating handle having a trip position when said operating mechanism is in the trip condition in said elongated slot, said elongated slot having a width at said trip position of the operating handle which is narrower than the enlarged terminal portion such that said cover cannot be removed from the housing when the operating handle is in the trip position.

3. The switching device of claim 2 wherein the trip position of said handle in said elongated slot is between said first and second positions.

4. The switching device of claim 1 wherein said terminal portion of said operating handle is enlarged in both directions transverse to said elongated slot.

5. The switching device of claim 1 wherein said operating handle moves in an arcuate path in said elongated slot and wherein a lower edge of the enlarged terminal portion of the operating handle is in close proximity to the cover with the operating handle in said second position.

6. The device of claim 1 adapted for use as a circuit breaker including a trip means responsive to an abnormal current flowing through said first and second contacts when closed to operate said operating mechanism to a tripped condition in which said first and second electrical contacts are open, said operating handle being in said first position when said operating mechanism is in said tripped condition.

7. The switching device of claim 1 wherein the enlarged terminal portion of said operating handle comprises a pin secured in a transverse bore through the terminal portion of the operating handle.

* * * * *